US008416175B2

(12) United States Patent
Hong et al.

(10) Patent No.: US 8,416,175 B2
(45) Date of Patent: Apr. 9, 2013

(54) LIQUID CRYSTAL DISPLAY DEVICE AND METHOD FOR DRIVING THE SAME

(75) Inventors: Jin Cheol Hong, Gumi-si (KR); Seung Cheol O, Seoul (KR); Jong Woo Kim, Gumi-si (KR)

(73) Assignee: LG Display Co. Ltd., Seoul (KR)

( * ) Notice: Subject to any disclaimer, the term of this patent is extended or adjusted under 35 U.S.C. 154(b) by 1141 days.

(21) Appl. No.: 12/137,841

(22) Filed: Jun. 12, 2008

(65) Prior Publication Data

US 2008/0309590 A1 Dec. 18, 2008

(30) Foreign Application Priority Data

Jun. 13, 2007 (KR) ..... 10-2007-0057906

(51) Int. Cl.
*G09G 3/36* (2006.01)

(52) U.S. Cl. ..... 345/98; 345/96

(58) Field of Classification Search ..... 345/37, 345/52, 54, 55, 59, 69, 87, 89, 96, 98–100, 345/103, 209, 559
See application file for complete search history.

(56) References Cited

U.S. PATENT DOCUMENTS 6,040,814 A * 3/2000 Murakami et al. ..... 345/94
7,453,432 B2 * 11/2008 Nii ..... 345/98
7,893,908 B2 * 2/2011 Morimoto et al. ..... 345/94

FOREIGN PATENT DOCUMENTS

JP 2006-003866 A * 5/2006

* cited by examiner

*Primary Examiner* — Quan-Zhen Wang
*Assistant Examiner* — Calvin C Ma
(74) *Attorney, Agent, or Firm* — Brinks Hofer Gilson & Lione

(57) ABSTRACT

The liquid crystal display device includes a liquid crystal panel including a common voltage correction unit that obtains predominant-polarity data based on polarities of image data to be supplied to pixel cells arranged in an nth one of pixel rows, obtains predominant-polarity data based on polarities of image data to be supplied to pixel cells arranged in an (n+1)th one of the pixel rows adjacent to the nth pixel row, obtains a sum of the two predominant-polarity data, and selects and outputting any one of a plurality of predetermined correction values based on the sum, and a common voltage output unit that corrects a common voltage based on the correction value from the common voltage correction unit and supplies the corrected common voltage to a common electrode.

8 Claims, 6 Drawing Sheets

(a)

(b)

LIQUID CRYSTAL DISPLAY DEVICE AND METHOD FOR DRIVING THE SAME

This application claims the benefit of Korean Patent Application No. 10-2007-0057906 filed on Jun. 13, 2007, which is hereby incorporated by reference as if fully set forth herein.

BACKGROUND OF THE INVENTION

1. Field of the Invention

The present invention relates to a liquid crystal display device, and more particularly, to a liquid crystal display device which can improve the quality of a picture, and a method for driving the same.

2. Discussion of the Related Art

A liquid crystal display device is adapted to display an image by adjusting light transmittance of pixel cells depending on a video signal. An active matrix type liquid crystal display device is advantageous in the display of moving images in that a switching element is formed for every pixel cell therein.

FIG. 1 shows the configuration of a conventional liquid crystal display device.

The conventional liquid crystal display device includes, as shown in FIG. 1, a liquid crystal panel having a plurality of pixel cells R, G and B arranged in matrix form.

Three adjacent red pixel cell R, green pixel cell G and blue pixel cell B in each pixel row H1 to Hn constitute one unit pixel PXL. One unit pixel PXL displays one unit image by combining a red color, a green color and a blue color.

Adjacent pixel cells are supplied with image data having opposite polarities. That is, the image data may be positive image data or negative image data, in which the positive image data signifies data having a voltage higher than a common voltage Vcom and the negative image data signifies data having a voltage lower than the common voltage Vcom.

In order to enable a striped pattern to appear on the screen of the conventional liquid crystal display device with the above-mentioned configuration, image data corresponding to a first halftone is supplied to odd unit pixels PXL in each pixel row H1 to Hn and image data corresponding to a second halftone is supplied to even unit pixels PXL in each pixel row H1 to Hn, thereby causing a degradation in picture quality resulting from a greenish phenomenon.

FIG. 2 illustrates the greenish phenomenon.

FIG. 2A shows image data supplied to pixel cells R, G and B in the first pixel row H1, in which image data corresponding to a first halftone is supplied to red, green and blue pixel cells R, G and B in each odd unit pixel PXL and image data corresponding to a second halftone is supplied to red, green and blue pixel cells R, G and B in each even unit pixel PXL. Here, the first halftone is a gray scale level lower than the second halftone. For example, the image data corresponding to the first halftone may have a lowest gray scale value among predetermined gray scale values, and the image data corresponding to the second halftone may have a highest gray scale value among the predetermined gray scale values. As a result, when the liquid crystal display device is driven in a normally white mode, each odd unit pixel PXL in each pixel row H1 to Hn exhibits a bright color close to white, and each even unit pixel PXL in each pixel row H1 to Hn exhibits a dark color close to black.

Pixel cells R, G and B in odd pixel rows including the first pixel row H1 exhibit a polarity pattern of 'positive, negative, positive, negative, . . . ' in order from the leftmost pixel cell, and pixel cells R, G and B in even pixel rows including the second pixel row H2 exhibit a polarity pattern of 'negative, positive, negative, positive, . . . , ' in order from the leftmost pixel cell.

Accordingly, in the pixel cells R, G and B in the odd pixel rows, as shown in FIG. 2A, the sum of the magnitudes of negative image data is larger than the sum of the magnitudes of positive image data. Consequently, the image data supplied to the pixel cells R, G and B in the odd pixel rows exhibits a negative attribute as a whole. In other words, the pixel cells R, G and B in the odd pixel rows exhibit a 'negative predominance' characteristic.

When image data is applied to the pixel cells R, G and B in the odd pixel rows, the common voltage Vcom falls in a negative direction under the influence of the above characteristic of the image data, as shown in FIG. 2A. The reference character Vcom' in FIG. 2A represents the falling common voltage Vcom.

As a result, pixel cells supplied with positive image data are ultimately applied with image data of larger magnitudes than normal ones due to the above variation of the common voltage Vcom. Conversely, pixel cells supplied with negative image data are ultimately applied with image data of smaller magnitudes than normal ones.

Consequently, when the liquid crystal display device is driven in the normally white mode, the red pixel cell R and blue pixel cell B, among the pixel cells R, G and B in each odd unit pixel PXL, relatively reduce in brightness and the green pixel cell G relatively increases in brightness.

On the other hand, in the pixel cells R, G and B in the even pixel rows, as shown in FIG. 2B, the sum of the magnitudes of positive image data is larger than the sum of the magnitudes of negative image data. Consequently, the image data supplied to the pixel cells R, G and B in the even pixel rows exhibits a positive attribute as a whole. In other words, the pixel cells R, G and B in the even pixel rows exhibit a 'positive predominance' characteristic.

When image data is applied to the pixel cells R, G and B in the even pixel rows, the common voltage Vcom rises in a positive direction under the influence of the above characteristic of the image data, as shown in FIG. 2B. The reference character Vcom' in FIG. 2B represents the rising common voltage Vcom.

Accordingly, positive pixel cells R, G and B are ultimately applied with image data of smaller magnitudes than normal ones due to the above variation of the common voltage Vcom. Conversely, negative pixel cells R, G and B are ultimately applied with image data of larger magnitudes than normal ones.

Consequently, when the liquid crystal display device is driven in the normally white mode, the red pixel cell R and blue pixel cell B, among the pixel cells R, G and B in each even unit pixel PXL, relatively reduce in brightness and the green pixel cell G relatively increases in brightness.

In this manner, because the common voltage Vcom varies in the direction of the predominant polarity of the image data, the green pixel cells G in the odd unit pixels PXL in all the pixel rows exhibit higher brightness than the red and blue pixel cells R and B. As a result, the greenish phenomenon in which the entire screen is greenish occurs, resulting in a degradation in picture quality.

SUMMARY OF THE INVENTION

A liquid crystal display device comprises: a liquid crystal panel including a plurality of pixel rows for displaying an image; a plurality of pixel cells arranged in each of the pixel rows; a common electrode provided in common in the pixel cells; a common voltage correction unit for obtaining predominant-polarity data based on polarities of image data to be supplied to the pixel cells arranged in an nth one of the pixel rows, obtaining predominant-polarity data based on polarities of image data to be supplied to the pixel cells arranged in an (n+1)th one of the pixel rows adjacent to the nth pixel row, obtaining a sum of the two predominant-polarity data, and selecting and outputting any one of a plurality of predetermined correction values based on the sum; and a common voltage output unit for correcting a common voltage based on the correction value from the common voltage correction unit and supplying the corrected common voltage to the common electrode.

In another aspect of the present invention, a method for driving a liquid crystal display device, where the liquid crystal display device comprises a liquid crystal panel including a plurality of pixel rows for displaying an image, a plurality of pixel cells arranged in each of the pixel rows, and a common electrode provided in common in the pixel cells, comprises: A) obtaining first predominant-polarity data based on polarities of image data to be supplied to the pixel cells arranged in an nth one of the pixel rows; B) obtaining second predominant-polarity data based on polarities of image data to be supplied to the pixel cells arranged in an (n+1)th one of the pixel rows adjacent to the nth pixel row; C) obtaining a sum of the first and second predominant-polarity data; D) selecting any one of a plurality of predetermined correction values based on the sum of the first and second predominant-polarity data; and E) correcting a common voltage to be supplied to the common electrode, based on the selected correction value.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. In the following description of the present invention, a detailed description of known functions and configurations incorporated herein will be omitted when it may make the subject matter of the invention rather unclear.

Figure 1:
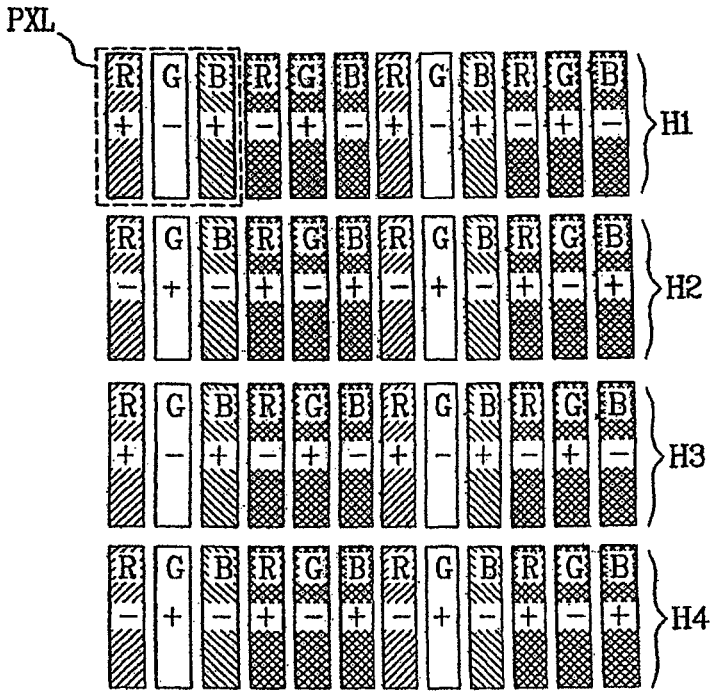
FIG. 1 Related Art
FIG. 1 is a view showing the configuration of a conventional liquid crystal display device.
Figure 2:
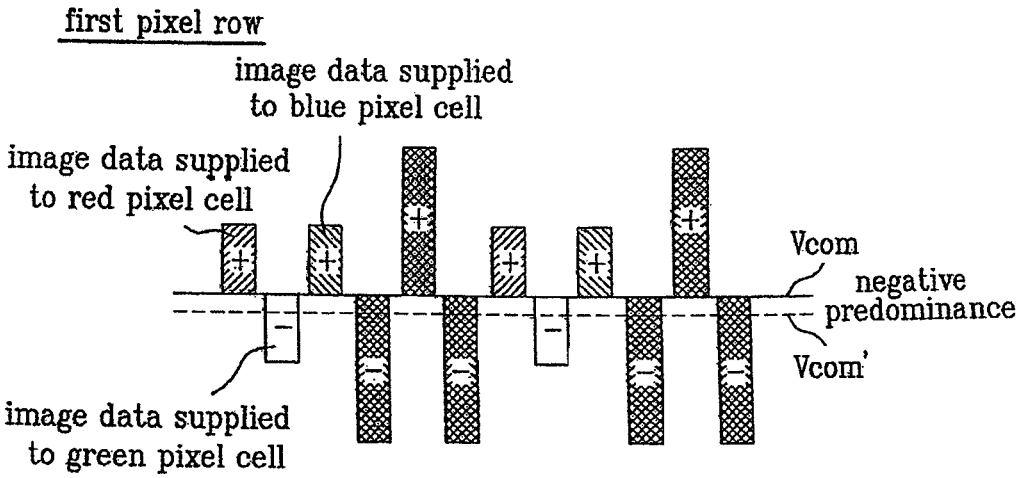
FIG. 2 Related Art
FIG. 2 is a view illustrating a greenish phenomenon.
Figure 2:
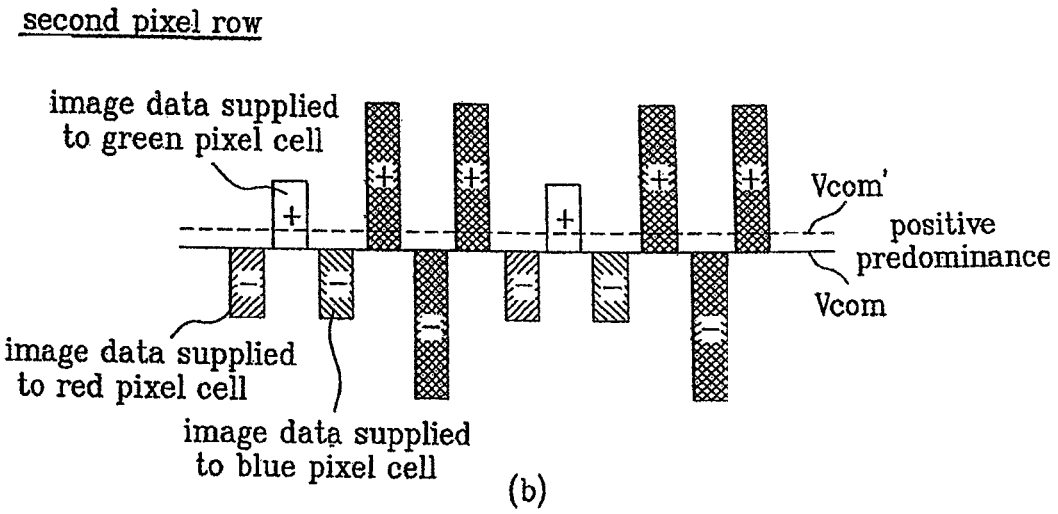
FIG. 2 Related Art
Figure 3:
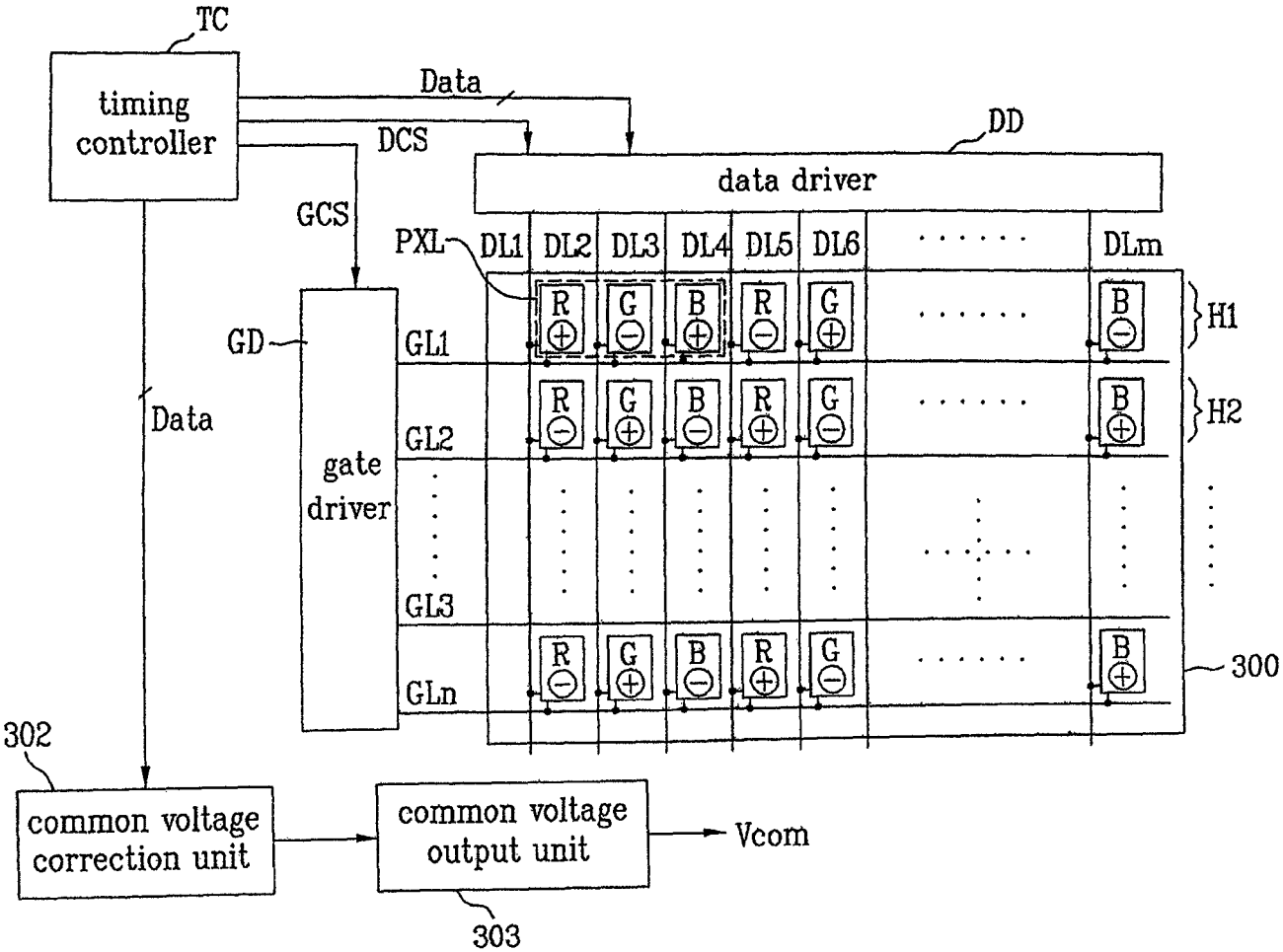
FIG. 3 is a block diagram showing the configuration of a liquid crystal display device according to an exemplary embodiment of the present invention.
Figure 4:
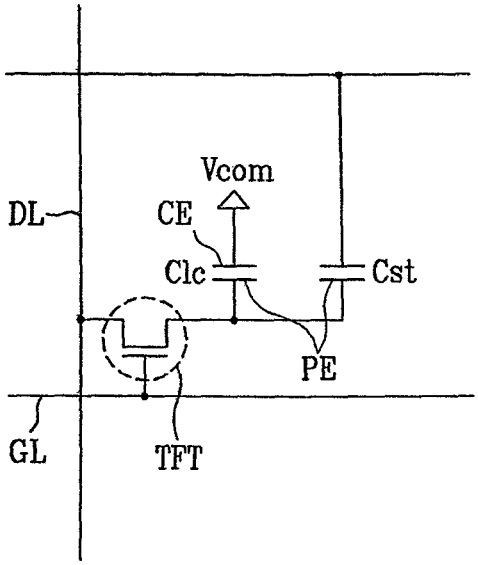
FIG. 4 is a circuit diagram showing the structure of each pixel cell in FIG. 3.

FIG. 3 is a block diagram showing the configuration of a liquid crystal display device according to an exemplary embodiment of the present invention, and FIG. 4 is a circuit diagram showing the structure of each pixel cell in FIG. 3.

The liquid crystal display device according to the present embodiment comprises, as shown in FIG. 3, a liquid crystal panel 300 including a plurality of pixel cells R, G and B arranged in matrix form and acting to display an image, and a driving circuit for driving the liquid crystal panel 300.

In the liquid crystal panel 300, a plurality of gate lines GL1 to GLn and a plurality of data lines DL1 to DLm are formed to cross each other.

At one side of each of the data lines DL1 to DLm, a plurality of pixel cells are arranged in a longitudinal direction of each of the data lines DL1 to DLm. Pixel cells connected in common to one data line are connected to the gate lines GL1 to GLn, respectively.

For example, pixel cells R, G and B connected in common to the first data line DL1 are connected to the first to nth gate lines GL1 to GLn, respectively.

Pixel cells R, G and B in each pixel row H1 to Hn are arranged in the order of a red pixel cell R, a green pixel cell G and a blue pixel cell B. Three adjacent pixel cells, or red pixel cell R, green pixel cell G and blue pixel cell B, in each pixel row H1 to Hn constitute one unit pixel PXL. One unit pixel PXL displays one unit image by combining a red color, a green color and a blue color.

Pixel cells R, G and B arranged in one pixel row are connected in common to one gate line.

Pixel cells R, G and B in odd pixel rows H1, H3, . . . , Hn−1 exhibit a polarity pattern of 'positive, negative, positive, negative, . . . ,' in order from the leftmost pixel cell, and pixel cells R, G and B in even pixel rows H2, H4, . . . , Hn exhibit a polarity pattern of 'negative, positive, negative, positive, . . . ,' in order from the leftmost pixel cell.

The polarity pattern of image data which is supplied to the pixel cells R, G and B in the odd pixel rows H1, H, . . . , Hn−1 and the polarity pattern of image data which is supplied to the pixel cells R, G and B in even pixel rows H2, H4, . . . , Hn are inverted every frame period.

Each pixel cell R, G or B includes, as shown in FIG. 4, a thin film transistor TFT for switching image data from the data line DL in response to a scan pulse from the gate line GL, a pixel electrode PE supplied with the image data from the thin film transistor TFT, a common electrode CE arranged to face the pixel electrode PE, and a liquid crystal layer disposed between the pixel electrode PE and the common electrode CE for adjusting light transmittance based on an electric field generated between the two electrodes PE and CE.

A liquid crystal capacitor Clc employing the liquid crystal layer as a dielectric is formed between the common electrode CE and the pixel electrode PE, and an auxiliary capacitor Cst employing an insulating film (not shown) as a dielectric is formed between the pixel electrode PE and the previous gate line GL overlapping the pixel electrode PE.

The common electrodes CE of the respective pixel cells R, G and B are formed integrally with one another, and a common voltage Vcom from a common voltage output unit 303 is applied to the integrally formed common electrode CE.

In practice, a predetermined gray scale voltage based on image data is supplied to the pixel electrode PE. That is, image data which is supplied to a data driver DD and a common voltage correction unit 302 is a digital voltage, and analog gray scale voltages are set based on this image data.

These analog gray scale voltages are supplied to the data lines DL1 to DLm and the pixel electrode PE.

Adjacent pixel cells are supplied with image data having opposite polarities. That is, the image data may be positive image data or negative image data, in which the positive image data signifies data having a voltage higher than a common voltage Vcom and the negative image data signifies data having a voltage lower than the common voltage Vcom.

The driving circuit includes a timing controller TC, a gate driver GD, a data driver DD, a power supply voltage generator (not shown), a polarity separator 301, and a common voltage correction unit 302.

The timing controller TC generates control signals DCS and GCS for driving of the data driver DD composed of a plurality of data drive integrated circuits and the gate driver GD composed of a plurality of gate drive integrated circuits using control signals inputted through an interface (not shown). Also, the timing controller TC transfers image data inputted through the interface to the data driver DD.

The timing controller TC includes a control signal generator and a data signal generator. The timing controller TC receives a horizontal synchronous signal, a vertical synchronous signal, a data enable signal, a clock signal and image data from the interface. The vertical synchronous signal represents a time required to display an image of one frame. The horizontal synchronous signal represents a time required to display one line, or one pixel row, of one frame. As a result, the horizontal synchronous signal includes the same number of pulses as the number of pixel cells included in one pixel row. The data enable signal represents a time at which image data is supplied to a pixel cell.

The data signal generator rearranges image data of certain bits supplied from the interface so that the image data can be supplied to the data driver DD. The control signal generator generates various control signals in response to the horizontal synchronous signal, vertical synchronous signal, data enable signal and clock signal received from the interface and supplies the generated control signals to the data driver DD and gate driver GD. A detailed description will hereinafter be given of the control signals DCS and GCS required respectively for the data driver DD and gate driver GD.

The control signal DCS required for the data driver DD includes a source sampling clock signal SSC, a source output enable signal SOE, a source start pulse signal SSP, and a liquid crystal polarity inversion signal POL. The source sampling clock signal SSC is used as a sampling clock for latching of image data in the data driver DD, and determines a driving frequency of the data drive integrated circuits. The source output enable signal SOE transfers image data latched by the source sampling clock signal SSC to the liquid crystal panel 300. The source start pulse signal SSP is a signal indicating the start of latching or sampling of image data in one horizontal synchronization period. The liquid crystal polarity inversion signal POL is a signal indicating a positive or negative polarity to drive the liquid crystal for inversion driving of the liquid crystal.

The data driver DD changes inputted image data to predetermined gray scale voltages in response to the control signal DCS inputted from the timing controller TC and supplies the gray scale voltages to the data lines DL1 to DLm.

The gate driver GD on/off-controls the thin film transistors TFTs arranged on the liquid crystal panel 300 in response to the control signal GCS inputted from the timing controller TC, and applies the gray scale voltages supplied from the data driver DD to the pixel electrodes PE connected respectively to the thin film transistors TFT. To this end, the gate driver GD outputs scan pulses sequentially and supplies the scan pulses to the gate lines GL1 to GLn in order. Whenever one gate line is driven, image data to be applied to pixel cells R, G and B of one pixel row is supplied to the m data lines DL1 to DLm.

The power supply voltage generator supplies an operating voltage of each constituent element, and generates and supplies a common electrode CE voltage of the liquid crystal panel 300.

The common voltage correction unit 302 obtains predominant-polarity data based on the polarities of image data to be supplied to pixel cells R, G and B arranged in an nth pixel row (n is a natural number), obtains predominant-polarity data based on the polarities of image data to be supplied to pixel cells R, G and B arranged in an (n+1)th pixel row adjacent to the nth pixel row, obtains the sum of the two predominant-polarity data, and selects and outputs any one of predetermined correction values based on the sum.

In other words, the common voltage correction unit 302 sequentially receives image data from the timing controller TC on a pixel row basis, and corrects the level of the common voltage Vcom to be applied to pixel cells R, G and B in a current pixel row to be supplied with image data, based on the sum of the predominant-polarity magnitude of the current pixel row and the predominant-polarity magnitude of a previous pixel row. For example, the level of the common voltage Vcom in a period in which the pixel cells R, G and B in the second pixel row H2 are supplied with image data is determined depending on the sum of the predominant-polarity magnitude of image data applied to the pixel cells R, G and B in the first pixel row H1 and the predominant-polarity magnitude of image data to be applied to the pixel cells R, G and B in the second pixel row H2.

The liquid crystal display device according to the present invention has a plurality of predetermined correction values based on the sum of the predominant-polarity magnitudes of the nth pixel row and (n+1)th pixel row to vary the common voltage Vcom. These correction values are stored in a correction lookup table 511.

The common voltage output unit 303 corrects the common voltage Vcom based on the correction value from the common voltage correction unit 302 and supplies the corrected common voltage Vcom to the common electrode CE.

Hereinafter, the common voltage correction unit 302 will be described in more detail.

Figure 5:
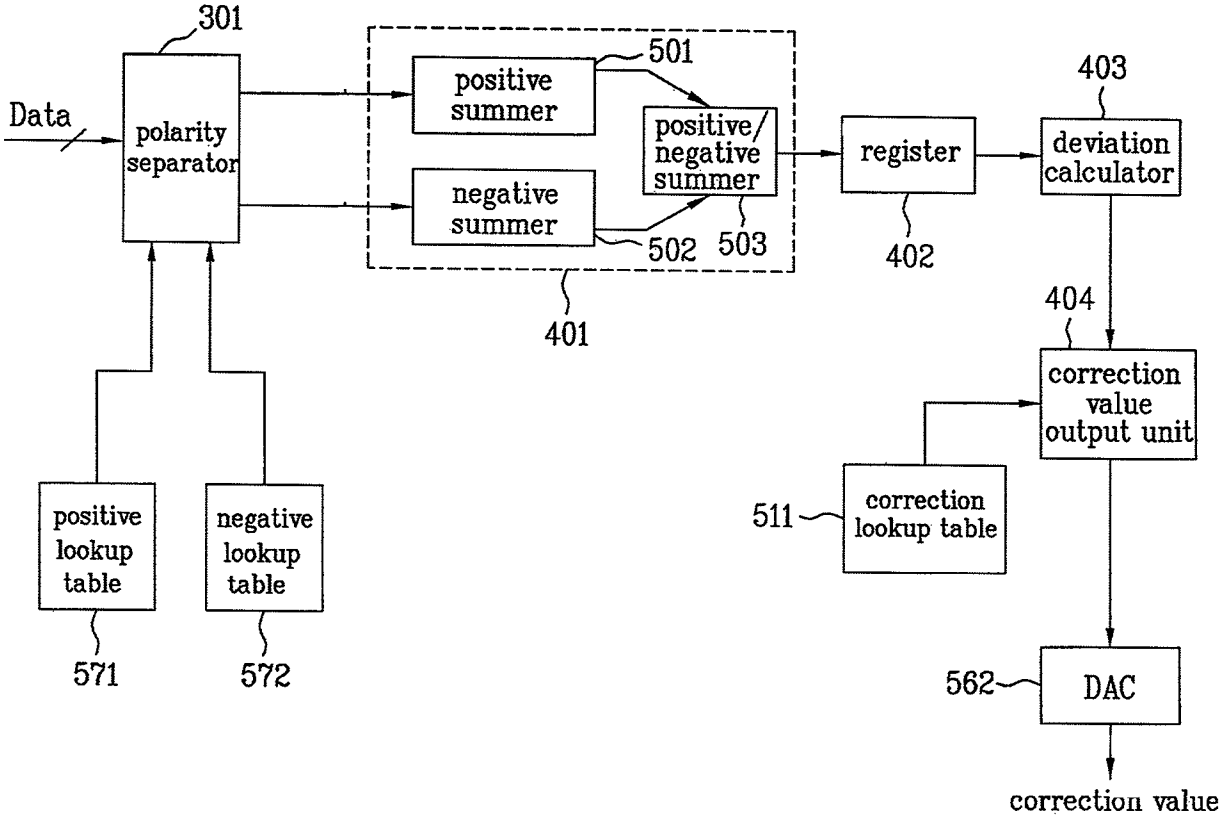
FIG. 5 is a block diagram showing the configuration of a common voltage correction unit in FIG. 3.

FIG. 5 shows the configuration of the common voltage correction unit 302 in FIG. 3.

The common voltage correction unit 302 includes, as shown in FIG. 5, a polarity separator 301, a positive lookup table 571, a negative lookup table 572, a predominant polarity calculator 401, a register 402, a deviation calculator 403, a correction value output unit 404, a correction lookup table 511, and a digital-analog converter 562.

The polarity separator 301 sequentially receives image data (digital image data) from the timing controller TC on a pixel row basis, and, whenever image data corresponding to pixel cells R, G and B in one pixel row is received, separates the received image data into positive image data and negative image data and outputs the separated positive image data and negative image data. That is, the polarity separator 301 separates and rearranges image data of pixel cells R, G and B in one pixel row into positive image data and negative image data and outputs the rearranged positive image data and negative image data.

At this time, the polarity separator 301 does not output the image data as it is, but converts the digital image data into analog values using the positive lookup table 571 and negative lookup table 572. Then, the polarity separator 301 grants a positive (+) attribute to the converted analog positive image data and a negative (−) attribute to the converted analog negative image data.

Analog image data corresponding to the magnitude of digital positive image data is stored in the positive lookup table 571, and analog image data corresponding to the magnitude of digital negative image data is stored in the negative lookup table 572.

The predominant polarity calculator 401 calculates the sum of the analog positive image data and analog negative image data from the polarity separator 301 to output predominant-polarity data. This predominant-polarity data means the sum of the sum of the positive image data and the sum of the negative image data.

Here, the predominant polarity calculator 401 includes a positive summer 501, a negative summer 502, and a positive/negative summer 503.

The positive summer 501 sums the positive image data to output positive sum data.

The negative summer 502 sums the negative image data to output negative sum data.

The positive/negative summer 503 calculates the sum of the positive sum data from the positive summer 501 and the negative sum data from the negative summer 502 to output predominant-polarity data and supply the predominant-polarity data to the register 402.

The register 402 sequentially stores two predominant-polarity data sequentially inputted from the predominant polarity calculator 401 in the inputted order, and updates an earlier stored one of the sequentially stored two predominant-polarity data to predominant-polarity data inputted next to the stored two predominant-polarity data.

That is, the register 402 includes two storage parts. When the predominant polarity calculator 401 outputs first predominant-polarity data, the register 402 receives the first predominant-polarity data and stores it in the first storage part. Thereafter, when the predominant polarity calculator 401 outputs second predominant-polarity data, the register 402 receives the second predominant-polarity data and stores it in the second storage part. Thereafter, the predominant polarity, calculator 401 outputs third predominant-polarity data, the register 402 receives the third predominant-polarity data and stores it in the first storage part. At this time, the first predominant-polarity data in the first storage part is deleted and the third predominant-polarity data is written in the first storage part.

The deviation calculator 403, whenever predominant-polarity data is stored in the register 402, calculates the sum of two predominant-polarity data stored in the register 402 to output deviation data. That is, the deviation data represents the sum of the two predominant-polarity data. Here, the deviation data has a positive or negative value based on the polarity and magnitude of the two predominant-polarity data.

The correction value output unit 404 receives the deviation data from the deviation calculator 403 and selects a correction value corresponding to the received deviation data from the correction lookup table 511. Then, the correction value output unit 404 provides the selected correction value to the common voltage output unit 303 through the digital-analog converter 562.

A plurality of correction values corresponding to deviation data are stored in the correction lookup table 511. The correction value output unit 404 selects and outputs a correction value corresponding to deviation data supplied thereto from the correction lookup table 511. At this time, the correction value, which is a digital signal, is converted into an analog signal through the digital-analog converter 562.

The correction value output unit 404 outputs the correction value synchronously with a period in which the pixel cells R, G and B in each pixel row H1 to Hn are driven. That is, the correction value output unit 404 outputs the correction value whenever the pixel cells R, G and B in each pixel row H1 to Hn are driven.

To this end, the correction value output unit 404 can output the correction value whenever one period of the horizontal synchronous signal is finished. That is, the correction value output unit 404 can output the correction value in a blank period of the each horizontal synchronous signal.

Alternatively, the correction value output unit 404 may output the correction value whenever the scan pulse for driving of the gate line is outputted.

The operation of the liquid crystal display device with the above-described configuration according to the present invention will hereinafter be described in detail.

First, a description will be given of an operation in a first period in which the pixel cells R, G and B in the first pixel row H1 are driven.

In the first period, first image data corresponding to the pixel cells R, G and B in the first pixel row H1 is outputted from the timing controller TC and supplied to the data driver DD and polarity separator 301.

The polarity separator 301 separates the first image data into positive image data and negative image data and converts the separated positive image data and negative image data into analog data. Then, the polarity separator 301 grants a positive (+) attribute to the converted analog positive image data and a negative (−) attribute to the converted analog negative image data. Then, the polarity separator 301 supplies the converted analog positive image data to the positive summer 501 and the converted analog negative image data to the negative summer 502.

Then, the positive summer 501 sums the positive image data to generate and output positive sum data, and the negative summer 502 sums the negative image data to generate and output negative sum data.

The positive sum data from the positive summer 501 and the negative sum data from the negative summer 502 are together supplied to the positive/negative summer 503. The positive/negative summer 503 calculates the sum of the positive sum data and the negative sum data to generate and output first predominant-polarity data.

The first predominant-polarity data from the positive/negative summer 503 is stored in the first storage part of the register 402.

The deviation calculator 403 obtains the sum of the predominant-polarity data stored in the first storage part and data stored in the second storage part. Meanwhile, dummy data having a value of 0 is pre-stored in the second storage part of the register 402. As a result, the deviation calculator 403 reads the first predominant-polarity data and dummy data from the register 402 and calculates the sum thereof to generate and output first deviation data.

The first deviation data is supplied to the correction value output unit 404, which then searches the correction lookup table 511 for a first correction value corresponding to the first deviation data supplied thereto and outputs the searched first correction value. This first correction value outputted from the correction value output unit 404 is supplied to the common voltage output unit 303 via the digital-analog converter 562.

Then, the common voltage output unit 303 reflects the magnitude of the first correction value in the common voltage Vcom to correct the common voltage Vcom, and outputs the corrected common voltage Vcom. The corrected common voltage Vcom may be smaller or higher than the original common voltage Vcom depending on the magnitude of the first correction value. The corrected common voltage Vcom is applied to the common electrode CE.

Here, at the time that the common voltage output unit 303 outputs and applies the corrected common voltage Vcom to the common electrode CE, the gate driver GD outputs the first scan pulse to drive the first gate line to which the pixel cells R, G and B in the first pixel row H1 are connected. Also, at this time, the data driver DD supplies gray scale voltages corresponding to the first image data respectively to the first to mth data lines at the same time. Each of these gray scale voltages is supplied to a corresponding one of the pixel cells R, G and B in the first pixel row H1 through a corresponding one of the data lines.

Accordingly, the pixel cells R, G and B in the first pixel row H1 display an image based on the corrected common voltage Vcom and the first image data.

Here, provided that the first image data supplied to the pixel cells R, G and B in the first pixel row H1 exhibits a 'negative predominance' characteristic as a whole, the common voltage correction unit 302 expects the common voltage Vcom to become lower than the original level, selects the first correction value so that the common voltage Vcom higher than the original common voltage Vcom can be applied to the common electrode CE, and provides the selected first correction value to the common voltage output unit 303.

Conversely, provided that the first image data supplied to the pixel cells R, G and B in the first pixel row H1 exhibits a 'positive predominance' characteristic as a whole, the common voltage correction unit 302 expects the common voltage Vcom to become higher than the original level, selects the first correction value so that the common voltage Vcom lower than the original common voltage Vcom can be applied to the common electrode CE, and provides the selected first correction value to the common voltage output unit 303.

Next, a description will be given of an operation in a second period in which the pixel cells R, G and B in the second pixel row H2 are driven.

In the second period, second image data corresponding to the pixel cells R, G and B in the second pixel row H2 is outputted from the timing controller TC and supplied to the data driver DD and polarity separator 301.

Then, the polarity separator 301, positive summer 501, negative summer 502 and positive/negative summer 503 operate in the same manner as in the above-stated first period. As a result, the positive/negative summer 503 outputs second predominant-polarity data based on the second image data.

This second predominant-polarity data is stored in the second storage part of the register 402. As a result, the dummy data stored in the second storage part in the previous period is deleted and the second predominant-polarity data is newly stored in the second storage part. Consequently, in the second period, the first predominant-polarity data is stored in the first storage part and the second predominant-polarity data is stored in the second storage part.

The deviation calculator 403 obtains the sum of the first predominant-polarity data stored in the first storage part and the second predominant-polarity data stored in the second storage part. That is, the deviation calculator 403 reads the first predominant-polarity data and second predominant-polarity data from the register 402 and calculates the sum thereof to generate and output second deviation data.

The second deviation data is supplied to the correction value output unit 404, which then searches the correction lookup table 511 for a second correction value corresponding to the second deviation data supplied thereto and outputs the searched second correction value. This second correction value outputted from the correction value output unit 404 is supplied to the common voltage output unit 303 via the digital-analog converter 562.

Then, the common voltage output unit 303 reflects the magnitude of the second correction value in the common voltage Vcom to correct the common voltage Vcom, and outputs the corrected common voltage Vcom. The corrected common voltage Vcom may be smaller or higher than the original common voltage Vcom depending on the magnitude of the second correction value. The corrected common voltage Vcom is applied to the common electrode CE.

Here, at the time that the common voltage output unit 303 outputs and applies the corrected common voltage Vcom to the common electrode CE, the gate driver GD outputs the second scan pulse to drive the second gate line GL2 to which the pixel cells R, G and B in the second pixel row H2 are connected. Also, at this time, the data driver DD supplies gray scale voltages corresponding to the second image data respectively to the first to mth data lines DL1 to DLm at the same time. Each of these gray scale voltages is supplied to a corresponding one of the pixel cells R, G and B in the second pixel row H2 through a corresponding one of the data lines DL1 to DLm.

Thus, the pixel cells R, G and B in the second pixel row H2 display an image based on the corrected common voltage Vcom and the second image data.

In order to supply the corrected common voltage Vcom to the pixel cells R, G and B in the second pixel row H2, it is first necessary to grasp the predominant polarity of the image data of the pixel cells R, G and B in the first pixel row H1 and the predominant polarity of the image data of the pixel cells R, G and B in the second pixel row H2. The reason is that each of the pixel rows, beginning with the second pixel row H2, is influenced by the common voltage Vcom supplied to the pixel row of the previous stage.

Therefore, in the present invention, when the common voltage Vcom is supplied to pixel cells R, G and B in a current pixel row, with the exception of the first pixel row H1, the predominant-polarity magnitude of image data to be supplied to the pixel cells R, G and B in the current pixel row, having an effect on the common voltage Vcom, and the predominant-polarity magnitude of image data supplied to pixel cells R, G and B in a previous pixel row are grasped and the sum thereof is obtained. Then, the level of the common voltage Vcom to be supplied to the pixel cells in the current pixel row is finally adjusted based on the obtained sum. This sum means deviation data, as stated previously.

The common voltage correction unit 302 controls the magnitude of the correction value according to several conditions as follows.

For example, in the case where the image data supplied to the pixel cells R, G and B in the previous pixel row exhibits a 'positive predominance' characteristic and the image data to be supplied to the pixel cells R, G and B in the current pixel row exhibits the 'positive predominance' characteristic, the common voltage Vcom to be supplied to the pixel cells R, G and B in the current pixel row is greatly influenced by the 'positive predominance' characteristic. In this case, the common voltage Vcom supplied to the pixel cells R, G and B in the current pixel row rises above the original value. For this reason, the common voltage correction unit 302 selects a correction value so that the common voltage Vcom can fall below the original value, and supplies the selected correction value to the common voltage output unit 303.

For another example, in the case where the image data supplied to the pixel cells R, G and B in the previous pixel row exhibits a 'negative predominance' characteristic and the image data to be supplied to the pixel cells R, G and B in the current pixel row exhibits the 'negative predominance' characteristic, the common voltage Vcom to be supplied to the pixel cells R, G and B in the current pixel row is greatly influenced by the 'negative predominance' characteristic. In this case, the common voltage Vcom supplied to the pixel cells R, G and B in the current pixel row falls below the original value. For this reason, the common voltage correction unit 302 selects a correction value so that the common voltage Vcom can rise above the original value, and supplies the selected correction value to the common voltage output unit 303.

For another example, in the case where the image data supplied to the pixel cells R, G and B in the previous pixel row exhibits the 'positive predominance' characteristic, the image data to be supplied to the pixel cells R, G and B in the current pixel row exhibits the 'negative predominance' characteristic and the 'positive predominance' characteristic is stronger than the 'negative predominance' characteristic, the common voltage Vcom to be supplied to the pixel cells R, G and B in the current pixel row is more influenced by the 'positive predominance' characteristic. In this case, because the common voltage Vcom supplied to the pixel cells R, G and B in the current pixel row rises above the original value, the common voltage correction unit 302 selects a correction value so that the common voltage Vcom can fall below the original value, and supplies the selected correction value to the common voltage output unit 303.

For another example, in the case where the image data supplied to the pixel cells R, G and B in the previous pixel row exhibits the 'positive predominance' characteristic, the image data to be supplied to the pixel cells R, G and B in the current pixel row exhibits the 'negative predominance' characteristic and the 'negative predominance' characteristic is stronger than the 'positive predominance' characteristic, the common voltage Vcom to be supplied to the pixel cells R, G and B in the current pixel row is more influenced by the 'negative predominance' characteristic. In this case, because the common voltage Vcom supplied to the pixel cells R, G and B in the current pixel row falls below the original value, the common voltage correction unit 302 selects a correction value so that the common voltage Vcom can rise above the original value, and supplies the selected correction value to the common voltage output unit 303.

For another example, in the case where the image data supplied to the pixel cells R, G and B in the previous pixel row exhibits the 'negative predominance' characteristic, the image data to be supplied to the pixel cells R, G and B in the current pixel row exhibits the 'positive predominance' characteristic and the 'positive predominance' characteristic is stronger than the 'negative predominance' characteristic, the common voltage Vcom to be supplied to the pixel cells R, G and B in the current pixel row is more influenced by the 'positive predominance' characteristic. In this case, because the common voltage Vcom supplied to the pixel cells R, G and B in the current pixel row rises above the original value, the common voltage correction unit 302 selects a correction value so that the common voltage Vcom can fall below the original value, and supplies the selected correction value to the common voltage output unit 303.

For another example, in the case where the image data supplied to the pixel cells R, G and B in the previous pixel row exhibits the 'negative predominance' characteristic, the image data to be supplied to the pixel cells R, G and B in the current pixel row exhibits the 'positive predominance' characteristic and the 'negative predominance' characteristic is stronger than the 'positive predominance' characteristic, the common voltage Vcom to be supplied to the pixel cells R, G and B in the current pixel row is more influenced by the 'negative predominance' characteristic. In this case, because the common voltage Vcom supplied to the pixel cells R, G and B in the current pixel row falls below the original value, the common voltage correction unit 302 selects a correction value so that the common voltage Vcom can rise above the original value, and supplies the selected correction value to the common voltage output unit 303.

Figure 6:
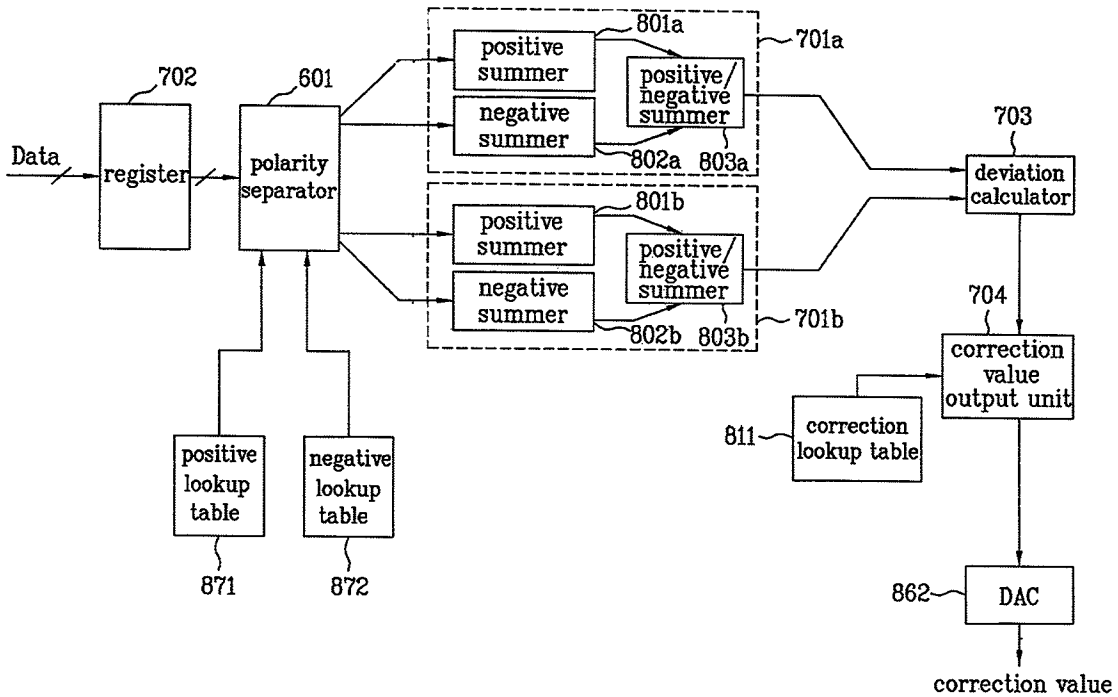
FIG. 6 is a block diagram showing another configuration of the common voltage correction unit in FIG. 3.

FIG. 6 is a block diagram showing another configuration of the common voltage correction unit 302 in FIG. 3.

The common voltage correction unit 302 includes, as shown in FIG. 6, a register 702, a polarity separator 601, a positive lookup table 871, a negative lookup table 872, a first predominant polarity calculator 701*a*, a second predominant polarity calculator 701*b*, a deviation calculator 703, a correction value output unit 704, a correction lookup table 811, and a digital-analog converter 862.

The register 702 sequentially receives image data externally inputted thereto on a pixel row basis, stores image data corresponding to pixel cells R, G and B in an nth pixel row and image data corresponding to pixel cells R, G and B in an (n+1)th pixel row, and updates the stored image data corresponding to the pixel cells R, G and B in the nth pixel row to image data to be supplied to an (n+2)th pixel row.

That is, the register 702 sequentially receives image data sequentially inputted from the timing controller TC on a pixel row basis, and sequentially stores two sets of image data to be supplied to pixel cells in adjacent pixel rows. Then, the register 702 updates an earlier stored one of the sequentially stored two sets of image data to image data inputted next to the stored two sets of image data.

In other words, the register 702 includes two storage parts. When the timing controller TC outputs first image data (image data to be supplied to the first pixel row H1), the register 702 receives the first image data and stores it in the first storage part. Thereafter, when the timing controller TC outputs second image data (image data to be supplied to the second pixel row H2), the register 702 receives the second image data and stores it in the second storage part. Thereafter, the timing controller TC outputs third image data (image data to be supplied to the third pixel row H3), the register 702 receives the third image data and stores it in the first storage part. At this time, the first image data in the first storage part is deleted and the third image data is written in the first storage part.

The polarity separator 601 receives the image data corresponding to the nth and (n+1)th pixel rows from the register 702, separates the received image data corresponding to the nth and (n+1)th pixel rows into positive image data and negative image data, and outputs the separated positive image data and negative image data.

That is, the polarity separator 601 separates the image data to be supplied to the pixel cells R, G and B in the nth pixel row into positive image data and negative image data and separates the image data to be supplied to the pixel cells R, G and B in the (n+1)th pixel row into positive image data and negative image data.

The first predominant polarity calculator 701*a* calculates the sum of the positive image data and negative image data corresponding to the pixel cells R, G and B in the nth pixel row from the polarity separator 601 to output first predominant-polarity data.

Here, the first predominant polarity calculator 701*a* includes a positive summer 801*a*, a negative summer 802*a*, and a positive/negative summer 803*a*.

The positive summer 801*a* sums the positive image data corresponding to the pixel cells R, G and B in the nth pixel row to output positive sum data.

The negative summer 802*a* sums the negative image data corresponding to the pixel cells R, G and B in the nth pixel row to output negative sum data.

The positive/negative summer 803*a* calculates the sum of the positive sum data from the positive summer 801*a* and the negative sum data from the negative summer 802*a* to output first predominant-polarity data and supply the first predominant-polarity data to the deviation calculator 703.

The second predominant polarity calculator 701*b* calculates the sum of the positive image data and negative image data corresponding to the pixel cells R, G and B in the (n+1)th pixel row from the polarity separator 601 to output second predominant-polarity data.

Here, the second predominant polarity calculator 701*b* includes a positive summer 801*b*, a negative summer 802*b*, and a positive/negative summer 803*b*.

The positive summer 801*b* sums the positive image data corresponding to the pixel cells R, G and B in the (n+1)th pixel row to output positive sum data.

The negative summer 802*b* sums the negative image data corresponding to the pixel cells R, G and B in the (n+1)th pixel row to output negative sum data.

The positive/negative summer 803*b* calculates the sum of the positive sum data from the positive summer 801*b* and the negative sum data from the negative summer 802*b* to output second predominant-polarity data and supply the second predominant-polarity data to the deviation calculator 703.

The deviation calculator 703 calculates the sum of the first predominant-polarity data from the first predominant polarity calculator 701*a* and the second predominant-polarity data from the second predominant polarity calculator 701*b* to output deviation data.

The correction value output unit 704 receives the deviation data from the deviation calculator 703, selects a correction value corresponding to the received deviation data from the correction lookup table 811 and provides the selected correction value to the common voltage output unit 303.

A plurality of correction values corresponding to deviation data are stored in the correction lookup table 811. The correction value output unit 704 selects and outputs a correction value corresponding to deviation data supplied thereto from the correction lookup table 811. At this time, the correction value, which is a digital signal, is converted into an analog signal through the digital-analog converter 862.

In the liquid crystal display device with the above-stated configuration according to the present invention, the register 702 has the two storage parts, as described above. In a period (first period) in which the pixel cells R, G and B in the first pixel row H1 are driven, dummy data having a value of 0 is pre-stored in one of the two storage parts, namely, the second storage part. Also, in the first period, the first image data to be supplied to the pixel cells R, G and B in the first pixel row H1 is stored in the first storage part of the register 702. The first image data stored in the first storage part of the register 702 is supplied to the first predominant polarity calculator 701*a* via the polarity separator 601, and the dummy data is supplied to the second predominant polarity calculator 701*b* via the polarity separator 601. Then, respective predominant-polarity data calculated by the respective calculators are supplied to the deviation calculator 703, which calculates the sum of these two predominant-polarity data. Here, in the first period, because the predominant-polarity data having the value of 0 is inputted to the deviation calculator 703, deviation data outputted from the deviation calculator 703 is substantially the same as the first predominant-polarity data.

In the remaining periods including a period in which the pixel cells R, G and B in the second pixel row H2 are driven, image data supplied to pixel cells R, G and B in a previous pixel row and image data to be supplied to pixel cells R, G and B in a current pixel row are supplied to the respective storage parts of the register 702.

These respective image data are supplied to the respective predominant polarity calculators 701*a* and 701*b* via the polarity separator 601, and respective predominant-polarity data from the respective predominant polarity calculators 701*a* and 701*b* are simultaneously inputted to the deviation calculator 703.

In this manner, according to the present invention, it is possible to accurately grasp the level of a common voltage Vcom to be supplied to pixel cells R, G and B in a current pixel row. Therefore, it is possible to prevent, not only a degradation in picture quality resulting from a greenish phenomenon in a conventional device, but also various picture quality degradations resulting from variations in the common voltage Vcom.

As apparent from the above description, the liquid crystal display device and the driving method thereof according to the present invention have effects as follows.

In the present invention, the predominant-polarity magnitude of image data to be supplied to pixel cells in a current pixel row and the predominant-polarity magnitude of image data supplied to pixel cells in a previous pixel row are grasped, the sum thereof is obtained, and the level of a common voltage to be supplied to the pixel cells in the current pixel row is adjusted based on the obtained sum. Therefore, the level of the common voltage supplied to a common electrode can be accurately maintained, thereby preventing a degradation in picture quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a liquid crystal panel including a plurality of pixel rows that display an image;

a plurality of pixel cells arranged in each of the pixel rows;

a common electrode provided in common in the pixel cells;

a common voltage correction unit that obtains predominant-polarity data based on polarities of image data to be supplied to the pixel cells arranged in an nth one of the pixel rows, obtains predominant-polarity data based on polarities of image data to be supplied to the pixel cells arranged in an (n+1)th one of the pixel rows adjacent to the nth pixel row, obtains a sum of the two predominant-polarity data, and selects and outputs any one of a plurality of predetermined correction values based on the sum; and a common voltage output unit that corrects a common voltage based on the correction value from the common voltage correction unit and supplies the corrected common voltage to the common electrode;

wherein the common voltage correction unit comprises:

a polarity separator that sequentially receives image data externally supplied thereto on a pixel row basis, and, whenever image data corresponding to pixel cells in one pixel row is received, separates the received image data into positive image data and negative image data and outputs the separated positive image data and negative image data;

a predominant polarity calculator that calculates a sum of the positive image data and negative image data from the polarity separator to output predominant-polarity data;

a register that sequentially stores two predominant-polarity data sequentially inputted from the predominant polarity calculator in the inputted order, and updates an earlier stored one of the sequentially stored two predominant-polarity data to predominant-polarity data inputted subsequently to the stored two predominant-polarity data;

a deviation calculator that calculates a sum of the two predominant-polarity data stored in the register to output deviation data;

a lookup table including the plurality of predetermined correction values by deviation data; and a correction value output unit that receives the deviation data from the deviation calculator, selects a correction value corresponding to the received deviation data from the correction lookup table and provides the selected correction value to the common voltage output unit.

2. The liquid crystal display device according to claim 1, wherein the predominant polarity calculator comprises:

a positive summer that sums the positive image data to output positive sum data;

a negative summer that sums the negative image data to output negative sum data; and a positive/negative summer that calculates a sum of the positive sum data from the positive summer and the negative sum data from the negative summer to output predominant-polarity data and supply the predominant-polarity data to the register.

3. The liquid crystal display device according to claim 2, wherein the common voltage correction unit further comprises:

a positive lookup table that stores predetermined analog positive image data by digital positive image data; and a negative lookup table that stores predetermined analog negative image data by digital negative image data, wherein the positive summer receives analog positive image data corresponding to the positive image data from the polarity separator, through the positive lookup table, and calculates a sum of the received analog positive image data, wherein the negative summer receives analog negative image data corresponding to the negative image data from the polarity separator, through the negative lookup table, and calculates a sum of the received analog negative image data.

4. The liquid crystal display device according to claim 1, wherein the common voltage correction unit further comprises a digital-analog converter that converts the correction value from the correction value output unit into an analog signal and provides the converted analog signal to the common voltage output unit.

5. A liquid crystal display device comprising:

a liquid crystal panel including a plurality of pixel rows that display an image;

a plurality of pixel cells arranged in each of the pixel rows;

a common electrode provided in common in the pixel cells;

a common voltage correction unit that obtains predominant-polarity data based on polarities of image data to be supplied to the pixel cells arranged in an nth one of the pixel rows, obtains predominant-polarity data based on polarities of image data to be supplied to the pixel cells arranged in an (n+1)th one of the pixel rows adjacent to the nth pixel row, obtains a sum of the two predominant-polarity data, and selects and outputs any one of a plurality of predetermined correction values based on the sum; and a common voltage output unit that corrects a common voltage based on the correction value from the common voltage correction unit and supplies the corrected common voltage to the common electrode;

wherein the common voltage correction unit comprises:

a register that sequentially receives image data externally inputted thereto on a pixel row basis, stores image data corresponding to the pixel cells in the nth pixel row and image data corresponding to the pixel cells in the (n+1)th pixel row, and updates the stored image data corresponding to the pixel cells in the nth pixel row to image data corresponding to the pixel cells in an (n+2)th one of the pixel rows;

a polarity separator that receives the image data corresponding to the pixel cells in the nth and (n+1)th pixel rows from the register, separates the received image data corresponding to the nth and (n+1)th pixel rows into positive image data and negative image data, and outputs the separated positive image data and negative image data;

a first predominant polarity calculator that calculates a sum of the positive image data and negative image data corresponding to the pixel cells in the nth pixel row from the polarity separator to output first predominant-polarity data;

a second predominant polarity calculator that calculates a sum of the positive image data and negative image data corresponding to the pixel cells in the (n+1)th pixel row from the polarity separator to output second predominant-polarity data;

a deviation calculator that calculates a sum of the first predominant-polarity data from the first predominant polarity calculator and the second predominant-polarity data from the second predominant polarity calculator to output deviation data;

a lookup table including the plurality of predetermined correction values by deviation data; and a correction value output unit that receives the deviation data from the deviation calculator, selects a correction value corresponding to the received deviation data from the correction lookup table and provides the selected correction value to the common voltage output unit.

6. The liquid crystal display device according to claim 5, wherein the first predominant polarity calculator comprises:

a positive summer that sums the positive image data corresponding to the pixel cells in the nth pixel row to output positive sum data;

a negative summer that sums the negative image data corresponding to the pixel cells in the nth pixel row to output negative sum data; and a positive/negative summer that calculates a sum of the positive sum data from the positive summer and the negative sum data from the negative summer to output first predominant-polarity data and supply the first predominant-polarity data to the deviation calculator.

7. The liquid crystal display device according to claim 5, wherein the second predominant polarity calculator comprises:

a positive summer that sums the positive image data corresponding to the pixel cells in the (n+1)th pixel row to output positive sum data;

a negative summer that sums the negative image data corresponding to the pixel cells in the (n+1)th pixel row to output negative sum data; and a positive/negative summer that calculates a sum of the positive sum data from the positive summer and the negative sum data from the negative summer to output second predominant-polarity data and supply the second predominant-polarity data to the deviation calculator.

8. A method for driving a liquid crystal display device, the liquid crystal display device comprising a liquid crystal panel including a plurality of pixel rows for displaying an image, a plurality of pixel cells arranged in each of the pixel rows, and a common electrode provided in common in the pixel cells, the method comprising:

A) obtaining first predominant-polarity data based on polarities of image data to be supplied to the pixel cells arranged in an nth one of the pixel rows;

B) obtaining second predominant-polarity data based on polarities of image data to be supplied to the pixel cells arranged in an (n+1)th one of the pixel rows adjacent to the nth pixel row;

C) obtaining a sum of the first and second predominant-polarity data;

D) selecting any one of a plurality of predetermined correction values based on the sum of the first and second predominant-polarity data; and E) correcting a common voltage to be supplied to the common electrode, based on the selected correction value;

wherein:

the step A) comprises calculating a sum of positive image data and negative image data to be supplied to the pixel cells in the nth pixel row to obtain first predominant-polarity data in the nth pixel row;

the step B) comprises calculating a sum of positive image data and negative image data to be supplied to the pixel cells in the (n+1)th pixel row to obtain second predominant-polarity data in the (n+1)th pixel row;

the step C) comprises calculating a sum of the first predominant-polarity data and the second predominant-polarity data to obtain deviation data; and the step D) comprises selecting a correction value corresponding to the deviation data from among the predetermined correction values.

* * * * *